US007157634B1

(12) United States Patent
Babicz

(10) Patent No.: US 7,157,634 B1
(45) Date of Patent: Jan. 2, 2007

(54) STRING INSTRUMENT

(76) Inventor: Jeffrey T. Babicz, 46 Fletcher Dr., Newburgh, NY (US) 12550

( * ) Notice: Subject to any disclaimer, the term of this patent is extended or adjusted under 35 U.S.C. 154(b) by 0 days.

(21) Appl. No.: 10/816,479

(22) Filed: Apr. 1, 2004

Related U.S. Application Data

(60) Provisional application No. 60/490,991, filed on Jul. 30, 2003.

(51) Int. Cl.
*G10D 3/00* (2006.01)

(52) U.S. Cl. ..... 84/293; 84/267

(58) Field of Classification Search ..... 84/290, 84/267, 291, 293
See application file for complete search history.

(56) References Cited

U.S. PATENT DOCUMENTS 3,204,510 A 9/1965 Hopf
3,550,496 A * 12/1970 Fender ..... 84/293
4,295,403 A * 10/1981 Harris ..... 84/293
4,432,267 A 2/1984 Feller
5,421,233 A * 6/1995 Bunker ..... 84/293
6,051,766 A 4/2000 Taylor
6,265,648 B1 * 7/2001 Steinberger ..... 84/293

* cited by examiner

*Primary Examiner*—Kimberly Lockett
(74) *Attorney, Agent, or Firm*—Joseph L. Spiegel; Heslin, Rothenberg, Farley & Mesiti, P.C.

(57) ABSTRACT

A stringed musical instrument, such as a guitar, wherein an easily accessible adjustment member allows the user to change the vertical height of the instrument's neck without affecting the angle of the neck relative to the guitar body. This invention allows the user to quickly adjust the action of the instrument without affecting the intonation or scale length of the guitar in one simple step without requiring the user to remove the strings, loosen any screws, or perform any additional mechanical adjustments.

12 Claims, 8 Drawing Sheets

STRING INSTRUMENT

CROSS REFERENCE TO RELATED APPLICATIONS

Provisional application No. 60/490,991 filed on Jul. 30, 2003.

BACKGROUND OF INVENTION

1. Field of the Invention

This invention relates to a string instrument and more particularly to a guitar.

2. Description of the Related Art

The design of modern guitars has remained relatively unchanged for many years. A traditional guitar is comprised of a body which is connected to a neck and has a plurality of strings strung at a substantial tension extending from a fixed point at the guitar neck to the bridge located on the lower region of the guitar body. The top of the neck on a traditional guitar contains a fretboard which is normally made of a hardwood or alternate substance such as maple, rosewood, ebony, or a re-enforced polymer. The material should be strong enough and stable enough to hold metal frets and be able to withstand playing wear.

Normally, the strings are tuned to pitch at the top of the neck or "headstock" where tuning pegs increase or decrease the tension on each string. The user then renders the desired notes by strumming the strings near the middle of the guitar body while pressing the strings which extend over the neck onto a fretboard attached to the upper surface of the neck. The tone of the note produced depends on the tension of the string and the distance between the fret at which the string is depressed onto the neck and the lower anchor point. The smaller the distance between the depressed string and the bridge, the higher pitch the resulting tone will be. Increasing the tension of the strings will also produce a note with a higher pitch.

An important aspect to the playability of a stringed instrument is the distance that the string lies above the neck. The height of the string relative to the neck and the fretboard is commonly referred to as a string's "action." Typically, the desired action on a guitar is subject to each user's personal preference. Certain musicians prefer to have a smaller distance between the fingerboard and the strings or "low" action while others require a high action in order to avoid fret buzzing, amongst other considerations. In general, very minute differences in the height that the string is above the neck can make a major difference on the performance of amateur and professional musicians alike.

On a traditional guitar, the action of the instrument is usually set at the factory and changes to the action must be made by an experienced technician. Furthermore, the traditional guitar normally has a very limited range of movement and significant changes to the action of the instrument may only be able to be accomplished by modifying the structure of the body or neck of the instrument. These type of modifications can be quite costly and can have a serious effect on the guitar's long term performance.

Consequently, it is desired to have a musical instrument that allows the user to quickly and efficiently adjust the action on the instrument.

The prior art references several string instruments which change the action of the instrument by adjusting the angle of inclination the neck extends from the guitar body. These devices rely on the principal that when the angle between the neck and the body is increased the action is lowered and when the angle is decreased the action is raised. However, while the action can be raised or lowered by adjusting the angle between the neck and the body of the guitar, changing angle of the neck relative to the body also effects the intonation, tonal properties and scale lengths of the guitar strings. The disadvantage to these designs is that the user cannot adjust the action of the neck without altering the intonation and sound of the guitar.

For instance, U.S. Pat. No. 6,051,766 discloses a guitar where the neck angle is changed relative to the guitar body by placing shims of varying widths into the guitar cavity that the neck is secured to the guitar body. Another adjustable neck is disclosed in U.S. Pat. No. 6,265,648 which provides for a neck secured to the guitar body via a spring-loaded clamping device that creates a pivot point allowing for movement of the neck at an angle relative to the body. Both of these devices do not permit the user to adjust the vertical direction of the neck without also changing the angle of the neck relative to the body. Furthermore, the U.S. Pat. No. 6,051,766 patent requires the user to disassemble the neck from the guitar body in order to adjust the action of the guitar strings. Additionally, the U.S. Pat. No. 6,265,648 patent relies on a spring's biasing force to hold the neck in place. This force of the spring is likely to degrade over time rendering the neck unstable. The force provided by the string also creates an upward force on the neck-body joint which can lead to damage of various structures on the guitar.

Consequently it is desired to have a neck which can be easily adjusted in a vertical direction without affecting the angle that the neck extends from the body.

SUMMARY OF INVENTION

The new invention is a stringed musical instrument that contains a vertically adjustable neck assembly. The neck assembly allows the user to quickly adjust the neck in the vertical direction without any change in the angle of the neck relative to the body. Consequently, the user can quickly and efficiently change the action of the guitar without affecting the intonation or scale length of the guitar strings by maintaining the angle of the neck relative to the body.

The neck is attached to the guitar by a 'heel-to-body' joint. In the preferred embodiment, the body of the instrument has adjoining means which provides a tight fitting interface between the neck and body to help the neck be securely mounted to the guitar body. The preferred embodiment for adjoining means features a neck block with a recess which helps create a pocket that is capable of receiving the heel of the neck and also bonds the back, sides, and soundboard together forming a solid structure.

In one embodiment of the adjoining means, the heel contains a recess between the heel and the inner heel that is nearly a perfect mate to the neck block. The fit between the heel and the inner heel is ideally tight but yet loose enough to allow for vertical movement of the neck via the neck height adjustment screw. The pocket conceals any possible gap that may form at the heel. To aid in the movement of the neck and minimize friction, guides made out of metal or a plastic material such as polypropylene are incorporated within the recess of the neck block. The guides are of a dimension so that the edges of the neck heel fit securely within the guides. The guides may be lubricated to help aid movement of the neck up and down the neck block. However, with a self gliding material, such as polypropylene, lubrication is unnecessary to provide a surface that is optimal for the movement of the neck.

The neck block and the heel of the neck contain sufficient recesses to allow for the inclusion of means for securing the neck heel to the neck block attached to the guitar body. In the preferred embodiment, the securing means is an assembly comprised of a neck height adjustment screw insert fixably secured within the neck heel for receiving a neck height adjustment screw. The neck height adjustment screw extends from the back of the guitar body through the neck block and is threaded through the screw insert to securely attach the neck to the body of the guitar. In its preferred embodiment, the guitar has means to restrict the height adjustment screws vertical motion whereby the screw is only allowed to turn in a clockwise or counter-clockwise direction with no corresponding vertical displacement. The height adjustment screws vertical motion can be restricted by means such as a trap plate that is engaged to the neck block located at the back of the guitar body.

To adjust the neck vertically up or down the user simply goes to the back of the guitar and turns the head of the neck adjustment screw extending passed the trap plate clockwise or counter-clockwise to raise or lower the neck height, respectively. The user can use a common tool such as an Allen key to perform this adjustment. In another embodiment, a wooden or metal knob can be securely attached to the head of the neck adjustment screw. In this embodiment, the user can make changes in the action by simply turning the knob in a clockwise or counter-clockwise direction. The trap plate can also have further access region structures and can be adorned with inlay material, such as mother of pearl, or a turned or molded, hole through wood or plastic button that is glued in position.

To provide further re-enforcement of the neck to the guitar body, the neck block can have recesses for neck securing screws on the side perpendicular to the recesses for the neck adjusting screws. The inner neck heel has a threaded recess for receiving the neck securing screws. When the neck securing screws are tightened, the pressure causes the neck heel to be fixably secured to the neck block. The user can access the neck securing screws through the soundhole and are periodically tightened to keep proper tightness within the heel slot, yet still having the ability, at any time, adjusting the neck height via the neck height adjustment screw. Further, to keep constant pressure on the threads of the neck height adjustment screw, a compression spring can be incorporated between the bottom of the neck block and the bottom of the inner heel of the neck.

In a preferred embodiment, the neck screw bolts and compression springs are eliminated and a set screw is used to place pressure between the inner neck heel and the neck block to fixably secure the neck to the guitar body. Tightening the setscrew causes the neck heel to exert pressure against the neck block in order to create a tight and secure neck-body joint. The user can access the setscrew through the guitar's soundhole. The user normally will only have to tighten the setscrew one time in order to provide permanent stability to the neck-body joint. In this embodiment, the user does not have to loosen any screws or perform any additional mechanical adjustments before manually adjusting the vertical height of the neck via the neck adjustment screw. This allows the user to adjust the height of the neck "on the fly" or during a performance without needing to de-tune the instrument's strings.

DETAILED DESCRIPTION OF THE INVENTION

Figure 1:
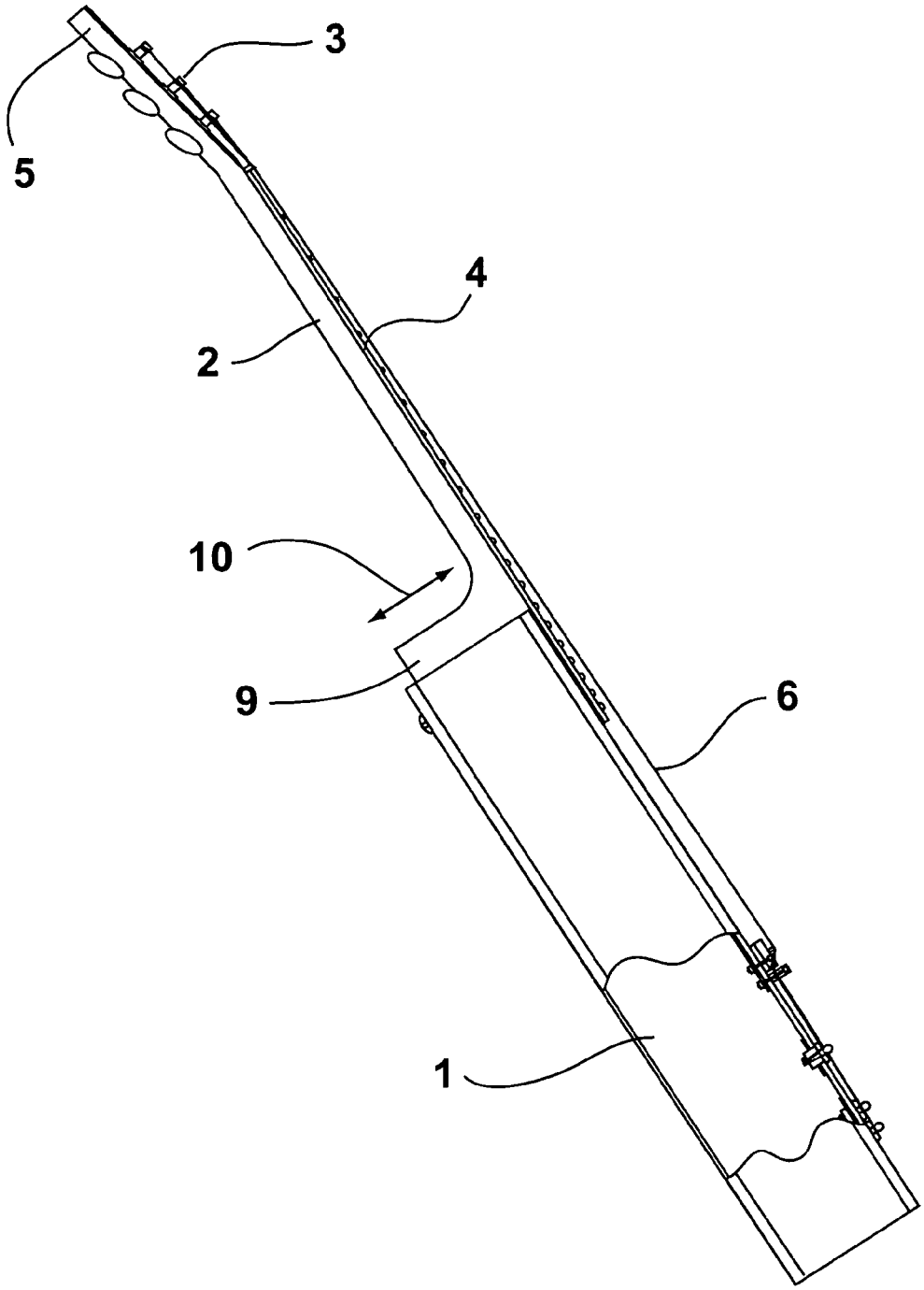
FIG. 1 is a side view of an acoustic guitar containing the adjustable neck invention.

For a more complete understanding of the invention, as well as other objects and further features thereof, reference may be had to the following detailed description of the invention in conjunction with the drawings wherein:

FIG. 1 shows a guitar body 1 which is connected to a neck 2 assembly. The neck is made of wood or a related material, which is suitable to withstand continual string pull without warping or twisting. The neck has a headstock 5, which holds the tuning pegs 3, which in turn hold the strings 6. The strings are strung at a substantial tension and extend from the fixed point created at the guitar neck to the lower string contacting means.

The neck is mated with a fretboard 4 which is made of a hard substance such as rosewood, ebony, or a re-enforced polymer. The material should be strong enough and stable enough to hold metal frets and withstand playing wear. The neck assembly features a "heel" 9 which is integral in allowing the neck assembly to be adjusted vertically 10 without changing the angle of the neck relative to the body. The traditional 'heel' construction look also adds to the high quality appearance associated with well constructed instruments.

Figure 2:
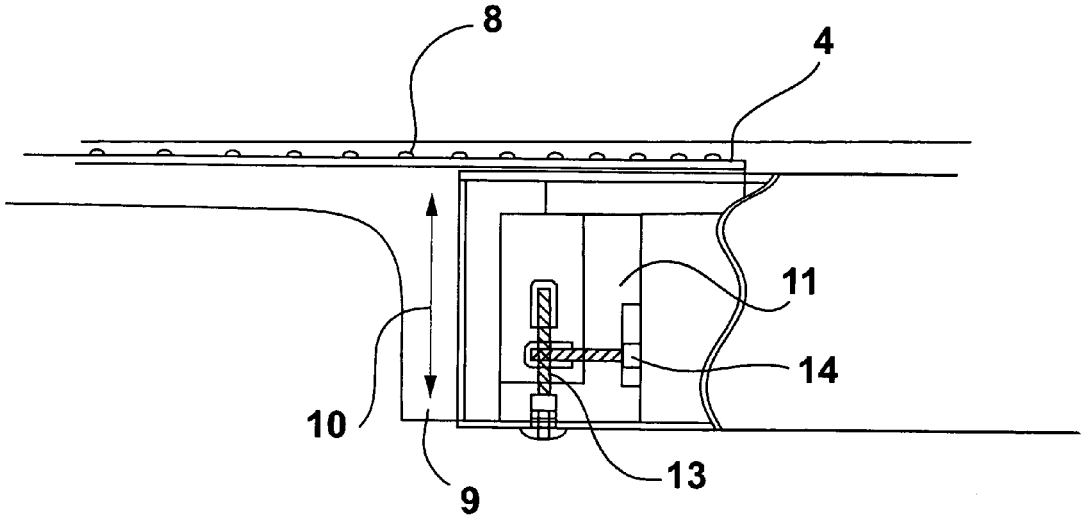
FIG. 2 is a cross section side view of the adjustable neck assembly.
Figure 3:
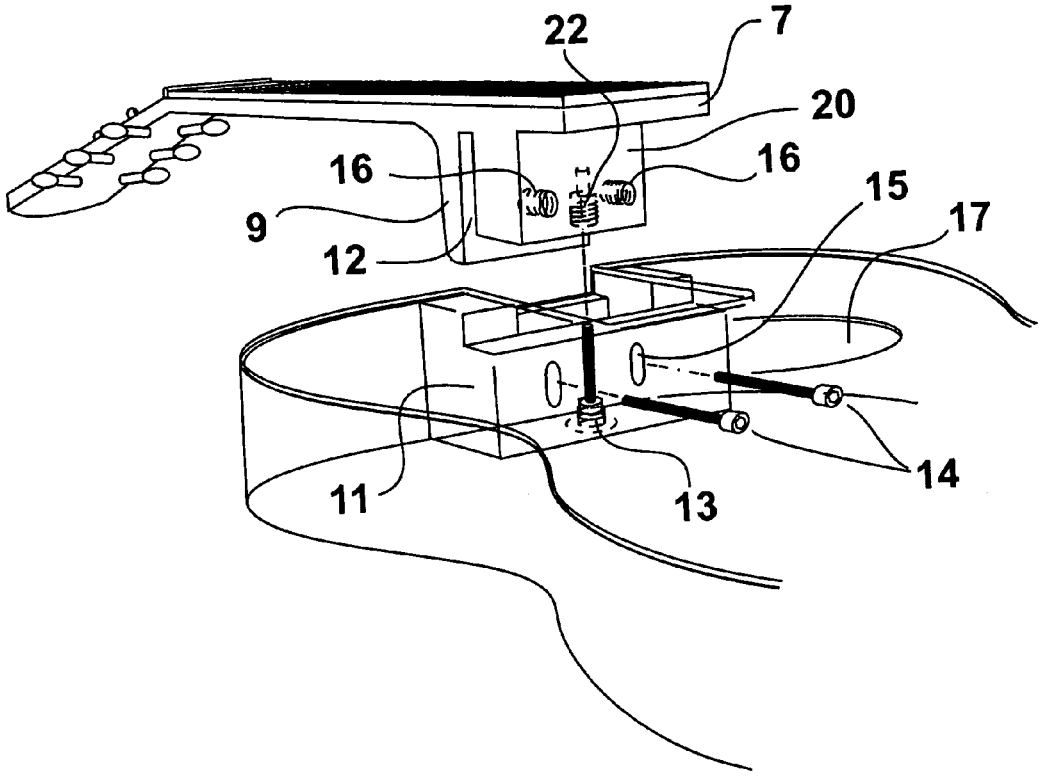
FIG. 3 is a transparent perspective view of the adjustable neck assembly.
Figure 4:
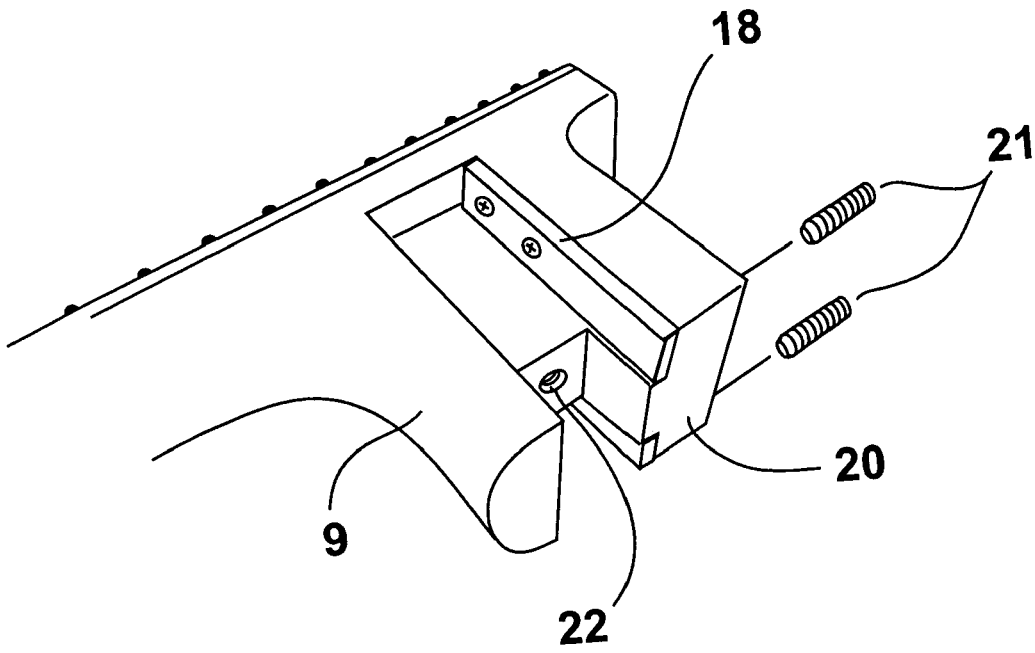
FIG. 4 is a perspective view of the neck and neck heel positioned on its side.

FIGS. 2–4 show a cross section side view, transparent perspective view of the adjustable neck assembly, and a perspective view of the neck heel 9 and inner heel 20 positioned on its side. The neck 2 can slide vertically up or down 10 to achieve the desired string height for proper playability. The neck has a fretboard supporting cantilever 7 portion that is integral to the neck. The cantilever portion should be thick enough to support the fretboard in a way to prevent movement, but not too thick to limit the vertical travel of the neck. The top playing surface is extremely flat and level with this type of neck construction.

The cantilever 7 portion of the neck sits below the level of the soundboard and never makes contact with the soundboard. This allows the neck to move freely vertically up or down to achieve the desired string height for proper playability. This also increases the sonic qualities of the instrument, as the material under the fretboard past the body of the guitar is rigid and sold, therefore offering more sustain and clarity. A further benefit is the soundboard is not restricted from vibrating in or near the neck area as found in traditional instrument construction.

The preferred embodiment is displayed wherein a tight fit between the neck and the body is provided by the heel 9 which contains a recess 12 between the heel and the inner heel 20 that is nearly a perfect mate to the neck block 11. The neck block 11 is attached to the body of the instrument. The neck block 11 can be made of mahogany, wood laminate, or other glueable materials that have sufficient structural integrity, without affecting the instrument's weight and balance. The neck block is of the dimensions so that it fits between the heel and the inner heel in a tight manner but still maintains enough looseness to allow for vertical movement of the neck via the neck height adjustment screw 13.

In the embodiment displayed in FIGS. 2–4, there are additional securing screws 14 which provide further re-enforcement of the neck to the guitar body. The additional securing screws 14 pass through recesses in the neck block and into a threaded recess in the inner neck heel 16 for receiving the neck securing screws. When the additional securing screws are tightened, clamping pressure is created which re-enforces the securement of the neck heel to the neck block. The user can access the neck securing screws through the soundhole 17 and can make periodic adjustments to maintain proper tightness within the heel slot.

FIG. 4 illustrates an embodiment of the adjustable neck assembly wherein the inner heel 20 has inserts 18 made out of a sturdy material such as metal that are secured in position. The neck height adjustment screw insert 22 is embedded within the neck between the heel 9 and the inner heel 20.

Figure 5:
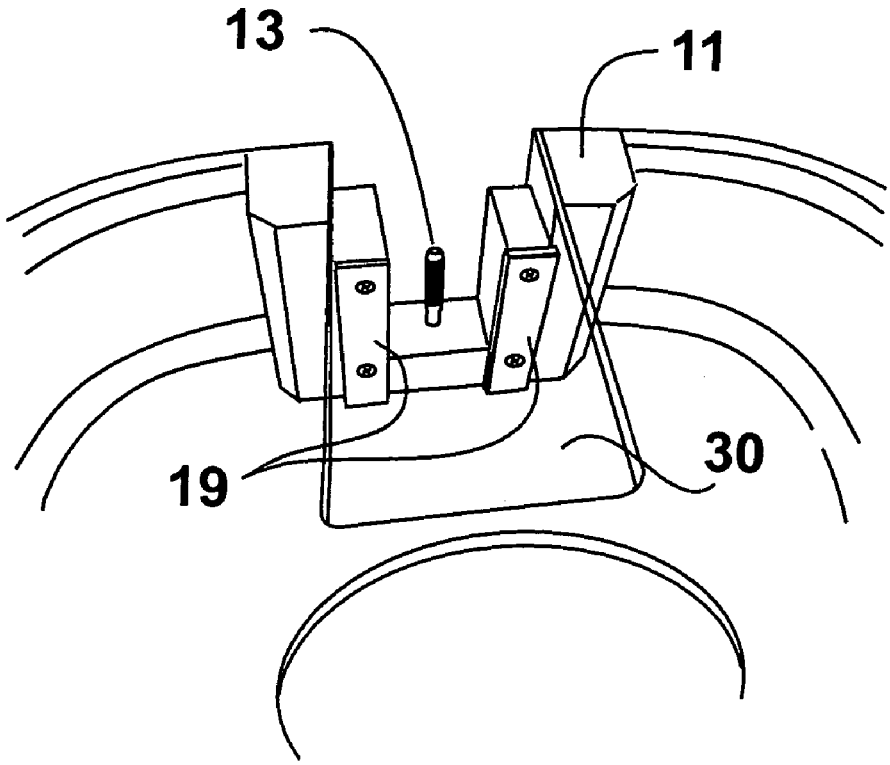
FIG. 5 is a top planar view of the neck pocket and neck block.

FIG. 5 shows a top planar view of the neck pocket 30 and neck block 11. The neck block 11 contains guides 19 made out of metal or a plastic material such as polypropylene. The guides 19 are shaped so that the neck heel inserts 18 fit securely within the guides. The guides aid in the movement of the neck and minimize friction.

Figure 6:
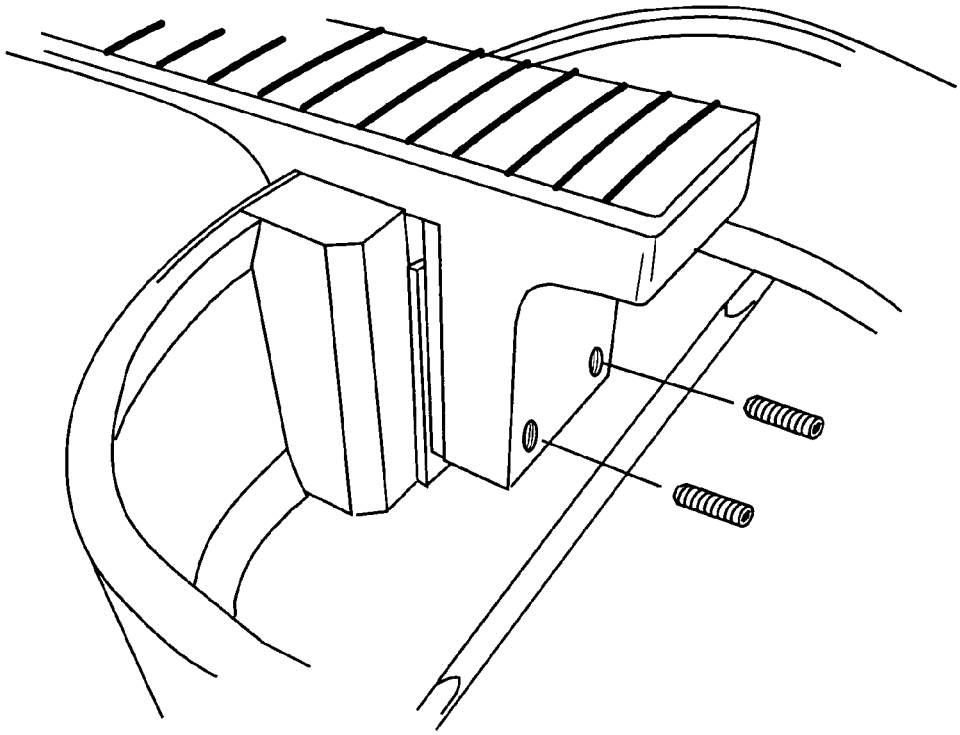
FIG. 6 is a perspective view of the adjustable neck assembly.

FIG. 6 shows a perspective view of the musical instrument with the neck mounted on the guitar body with the soundboard removed.

Figure 7:
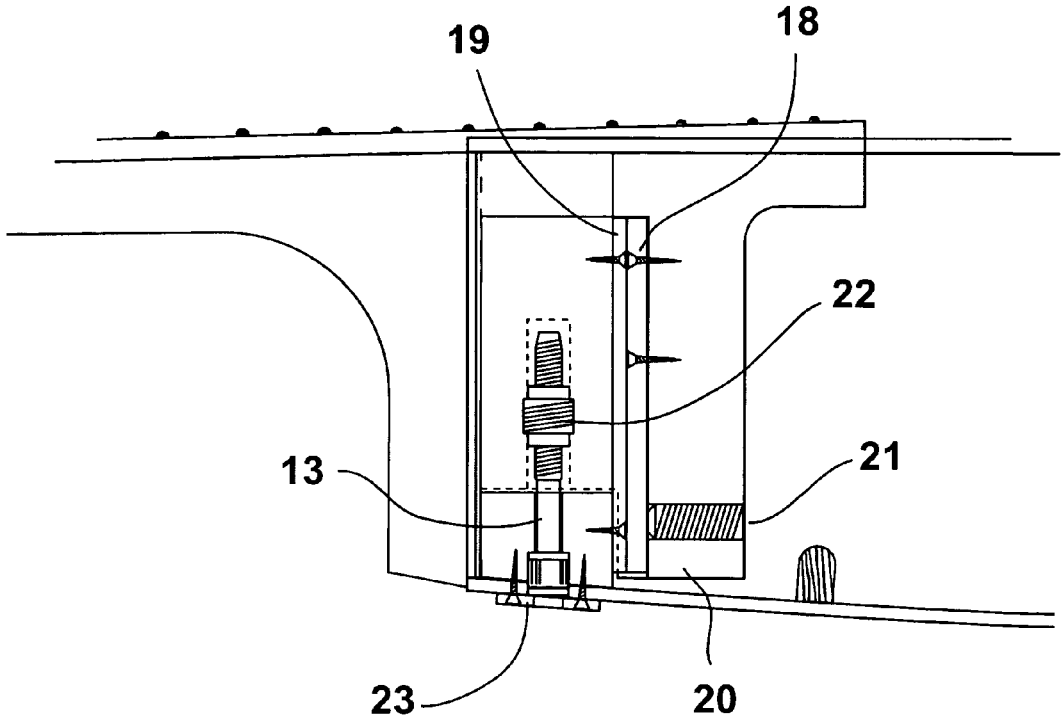
FIG. 7 is a cross section side view of the adjustable neck assembly.

FIG. 7 is a cross section side view of the adjustable neck assembly. In the preferred embodiment, a setscrew 21 is placed inside the inner heel 20 of the neck. The user can access the setscrew 21 through the soundhole 17. The setscrew mounts the neck to the body by exerting pressure to the neck heel insert 18 and guides 19 then between the neck heel 9 and the neck block 11 when tightened, thereby fixably securing the neck to the guitar body. This setscrew 21 needs to only be tightened once by the user and no further tightening is necessary throughout the life of the instrument unless the neck is removed from the instrument's body.

FIGS. 4 & 7 illustrate the preferred embodiment for the adjusting means which allows the neck to move in a vertical direction without changing the angle of the neck relative to the guitar body. The adjusting means assembly comprises a neck height adjustment screw insert 22 that is fixably secured within the inner neck heel 20. The height adjustment screw 13 extends from the back of the guitar body through a recess in the neck block and is threaded through the height adjustment screw insert 22. The neck height adjustment screw/neck height adjustment screw insert interface attaches the neck to the body of the guitar and allows adjustments to the vertical position 10 of the neck relative to the body to increase by turning the screw to bring the body and neck closer or farther apart from each other. To adjust the neck vertically up or down the user simply accesses the back of the guitar and turns the neck adjustment screw clockwise or counter-clockwise to raise or lower the neck height, respectively.

Figure 8:
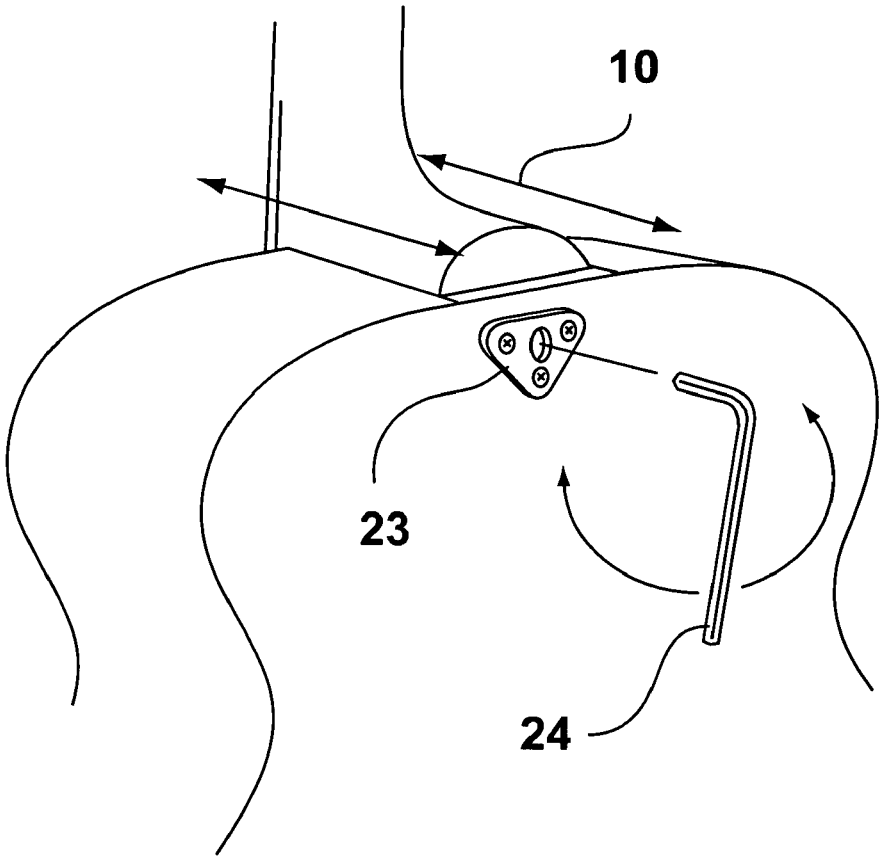
FIG. 8 is a side view of the back of the guitar.

FIGS. 7–8 detail the preferred embodiment wherein the guitar has means to restrict the height adjustment screw's vertical motion. In the displayed embodiment a trap plate 23 is engaged to the neck block 11 at the back of the guitar body. The trap plate 23 restricts the vertical motion of the height adjustment screw 13 so that the screw's motion is limited to a clockwise or counter-clockwise direction with no corresponding vertical displacement.

In the displayed embodiment, the user can use a common tool such as an Allen key 24 to turn the screw and thereby adjust the vertical position 10 of the guitar neck.

The invention claimed is:

1. A stringed musical instrument comprising:

a body, a neck;

one or more strings stretched over said body and said neck;

mounted means for mounting said neck to said body; and continually adjustable means to move said neck vertically without changing the angle of said neck relative to said body wherein said continually adjustable means comprises: a height adjustment screw insert fixably secured to said neck; and a height adjustment screw extending from the back of said body through said height adjustment screw insert, said height adjustment screw fixably engaging said body to said neck and providing for the adjustment of the vertical height of said neck relative to said body by turning said height adjustment screw in a clockwise or counter-clockwise direction to increase or decrease the distance said neck extends from said body, said height adjustment screw extending through a trap plate at the back of the instrument body, said trap plate configured to restrict the vertical movement of said height adjustment screw.

2. The musical instrument as set forth in claim 1 wherein said body and said neck have adjoining means for providing a tightly fitting neck-body interface so that the neck can be securely mounted to said body by said mounting means.

3. The musical instrument as set forth in claim 2 wherein said adjoining means comprises: a neck block attached to said body;

said neck block having a receiving recess for the bottom of said neck; and said neck having a bottom approximately the same size as said receiving recess.

4. The musical instrument as set forth in claim 3 wherein said neck block bottom has edges and guides are attached to the bottom of said neck and said guides are of a dimension so that it can securely accommodate the edges of the bottom of said neck.

5. The musical instrument as set forth in claim 4 wherein said guides are comprised of a self-guiding material.

6. The musical instrument as set forth in claim 3 wherein said has a bottom wall and said mounting means comprises a setscrew in the bottom wall of said neck, said sets applying pressure on said neck block to fixably secure the neck to the body.

7. The musical instrument as set forth in claim 3 wherein a spring is inserted between the bottom of the neck block and the bottom of the neck to provide constant pressure on the neck adjustment screw.

8. The musical instrument as set forth in claim 1 wherein the head of said height adjustment screw has a knob or lever fixably secured to it in order to allow the user to easily adjust said height adjustment screw without the need for any tools.

9. The musical instrument as set forth in claim 1 wherein said mounting means comprises neck mounting screws that extend from the neck and are threaded through said body.

10. The musical instrument as set for in claim 9 wherein said mounting means comprises: neck mounting screws that extend through the bottom of said neck; and threaded recesses in sad neck block for receiving said neck mounting screws.

11. The musical instrument as set forth in claim 1 wherein a spin is inserted in the neck body joint to provide constant pressure on the adjustment means.

12. The musical instrument as set forth in claim 3 wherein said mounting means comprises a setscrew in said neck and said setscrew applies pressure between the neck and the body when tightened to fixably secure the neck to the body.

* * * * *